United States Patent [19]

Seyler

[11] Patent Number: 4,757,623

[45] Date of Patent: Jul. 19, 1988

[54] NAMEPLATE HOLDER

[76] Inventor: Alvin W. Seyler, 3350 S. Orange Blossom Trail, P.O. Box 428, Kissimmee, Fla. 32741

[21] Appl. No.: 44,415

[22] Filed: Apr. 30, 1987

[51] Int. Cl.[4] ..... A47G 1/06

[52] U.S. Cl. ..... 40/152.1; 40/642 R; 40/605; 40/358; 248/473

[58] Field of Search ..... 40/152.1, 10 R, 11 R, 40/152, 605, 606, 358; 248/469, 473; 52/822, 823

[56] References Cited

U.S. PATENT DOCUMENTS

| | | | |
|---|---|---|---|
| D. 173,776 | 12/1954 | Westernacher . | |
| 3,282,437 | 11/1966 | Hansen | 248/473 |
| 3,361,131 | 1/1968 | Barger | 248/473 |
| 3,774,331 | 11/1973 | Coelho | 248/473 |

FOREIGN PATENT DOCUMENTS

| | | | |
|---|---|---|---|
| 906587 | 1/1946 | France | 248/473 |
| 610986 | 10/1948 | United Kingdom | 248/473 |

OTHER PUBLICATIONS

Lake Shore Markers advertisement, *Signs of the Times*; Sep. 1987, p. 173.

*Primary Examiner*—Gene Mancene
*Assistant Examiner*—Cary E. Stone
*Attorney, Agent, or Firm*—Julian C. Renfro

[57] ABSTRACT

A sign in accordance with this invention comprises a pair of end members, with each end member having a longitudinal groove, and with each of the end members having a foot portion configured such that the respective longitudinal groove bears approximately a 15° relationship to the vertical. The longitudinal groove in one of the end members faces the longitudinal groove in the end member such that respective ends of a generally rectangular sign of appropriate thickness may be closely received in these grooves. Importantly, the groove in each of the end members is of dual width, with one portion of each such groove being wide and of comparatively shallow depth, whereas another portion of each of the grooves is comparatively narrow, and of greater depth. Because of this arrangement, elongate panel members of either of two different thicknesses can be readily received in a tight fitting manner in appropriate portions of the grooves.

8 Claims, 2 Drawing Sheets

NAMEPLATE HOLDER

BACKGROUND OF THE INVENTION

It has been well known for many years to provide a sign for nameplate suitable for placement on desks, tables, and other pieces of furniture. Many of such signs or nameplates were supported on holders that were of expensive construction, but that still do not serve to display such sign in an attractive manner.

It has also been known to utilize signs and nameplates supported by an end member at each end, with each such end member having a foot member thereon established in the proper relationship to cause the sign to be displayed at a slight angle to the vertical, such that it would be readily readable. However, those end members were usually of relatively unattractive appearance, but even more importantly, they were always limited to use with signs or nameplates of a single thickness.

It is because of the distinct limitations and disadvantages of the prior art end members used for sign support that I was motivated to evolve holders for signs and nameplates that could be used with signs and nameplates of more than one thickness.

SUMMARY OF THIS INVENTION

In accordance with this invention I have provided a sign utilizing a pair of novel end members such that signs and nameplates of more than a single thickness may be tightly received therein. Each of the end members is equipped with a longitudinal groove and a foot member, with the relationship between longitudinal groove and foot member being such that a sign or nameplate extending between a pair of end members is caused to reside at a slight angle to the vertical.

Advantageously, the slot or groove in each of the end members in accordance with this invention is of dual width and dual depth, with one portion in each such slot or groove being wide and of compartively shallow depth, whereas another portion of each of such grooves is comparatively narrow and of greater depth. Because of this construction, I may utilize my novel end members with at least two different thicknesses of signs or nameplates, such that a sign or nameplate of one thickness may be received and frictionally held in the end members equally as well as a sign or nameplate of a distinctly different thickness.

As a result of such construction, it is no longer necessary for an office supply or other such company to stock nameplate holders of different configurations, for by utlizing nameplate holders in accordance with my invention, signs and nameplates of two different standard thicknesses may be utilzed quite satisfactorily.

It is therefore a principal object of my invention to provide a nameplate holders of low cost and attractive appearance, usable with a plurality of thicknesses of sign material.

It is another object of my invention to provide nameplate holders or end members designed to frictionally receive signs or nameplates of two different thicknesses, and to retain either of such nameplates in a desirable and highly satisfactory manner.

It is still another object of my invention to provide nameplate holders utilized in pairs, with each holder having novel, dual width channels or slots, with the channel or slot in one holder facing the channel or slot in the other holder, with nameplates or signs of comparatively great thickness being received to a comparatively shallow depth in the channel of each of the holders, whereas nameplates or signs of a comparatively small thickness are received to a somewhat greater depth in each of the holders.

Other objects, features and advantages of this invention will be more apparent as the description proceeds.

Figure 4A:
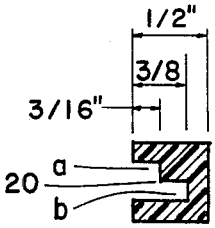
FIG. 4 is an edge view of the same end member, with this view revealing the precise nature of the dual width, dual depth slot or channel in the end member.
Figure 3:
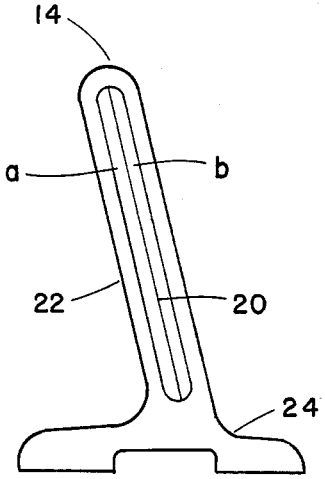
FIG. 3 is a view of the open side of a typical single end member in accordance with this invention, member 14 in this instance, revealing a dual width slot or channel therein to frictionally receive the edge or end of a sign or nameplate.
Figure 4:
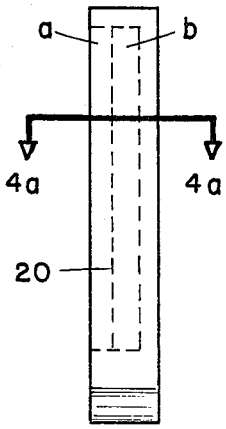
Figure 5:
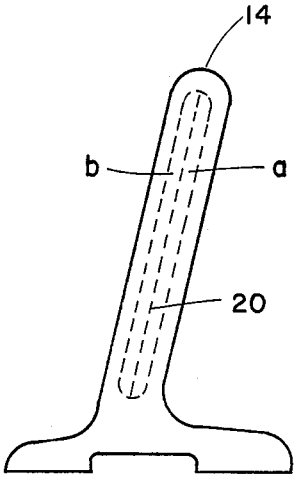
Figure 6:
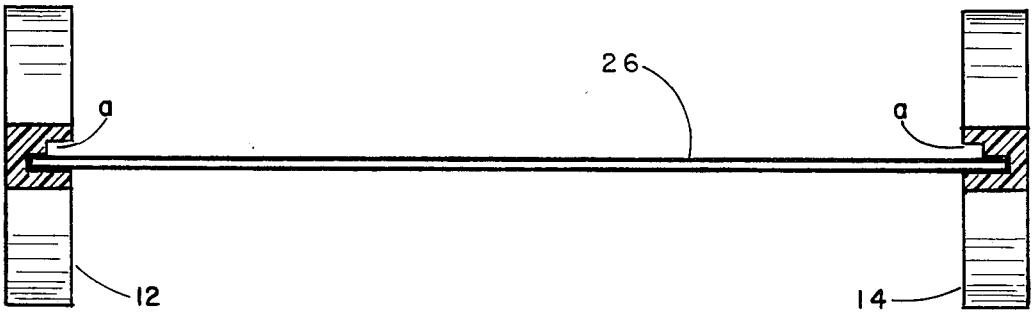
Figure 7:
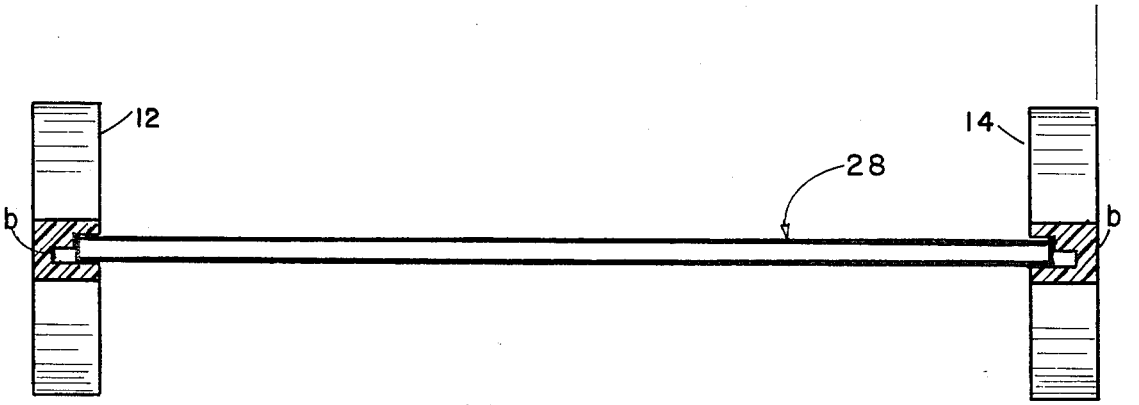

FIG. **4*a* is a cross sectional view of the end member, taken at 4*a*—4*a* in FIG. 4**;

FIG. 5 is an edge view taken from the other side of the same end member depicted in FIG. 3, with the locatinons of the shallow and deep portions of the slot being depicted in dashed lines;

FIG. 6 is a sectional view of a different type, with a nameplate of comparatively small thickness being shown to enter to the very bottom of the slot or groove; and FIG. 7 is a similar sectional view to that of FIG. 6, except that in this instance a nameplate of comparatively greater thickness is being shown to enter only part of the way into the dual depth slot.

DETAILED DESCRIPTION

Figure 1:
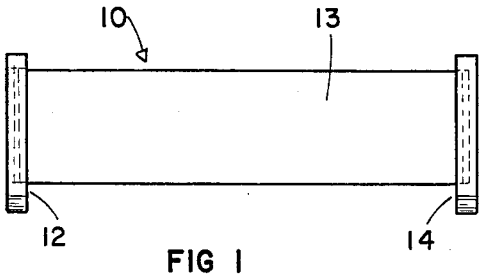
FIG 1 PRIOR ART
FIG. 1 is a front view of a sign or nameplate holder in accordance with the prior art, with it to be noted that the individual holders serving as the support means for this sign are used at the ends of the sign.

Turning first to FIG. 1, it will be seen in this view captioned Prior Art, that I have illustrated a sign or nameplate 10 held at the left end by a holder or end member 12, and held at the right end by a holder or end member 14. Both of these end members contain a slot or channel to receive and frictionally retain a sign or nameplate, and thus far it is to be seen that my invention superficially resembles devices of the prior art.

Figure 2:
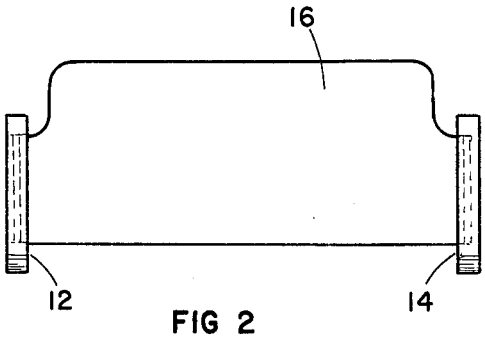
FIG 2 PRIOR ART
FIG. 2 is a similar front view of a sign or nameplate holder, but showing that end members of standard size can be used with signs or nameplates that have an enlarged mid portion to permit use thereon of larger and any length letters, with it to be understood that the nameplates can be of any practical length.

In FIG. 2, likewise captioned Prior Art, it is to be seen that the sign or nameplate 16 has end members of the same vertical dimension as the ends of the nameplate 10, but with a mid-portion of greater height, thus enabling larger letters to be used on the sign or nameplate 16 than were possible on nameplate 10. Because of the conforming of the ends of the sign to be received in slots of the same height as the slots utilized in the device of FIG. 1, it is thus to be seen that signs of various heights and various lengths may be readily accommodated. I have found that signs in the general configuration of sign 16 in FIG. 2 can be up to approximately 5 inches in height.

With regard to FIG. 3, it is to be seen that an end member of nameplate holder 14 in accordance with this invention contains a slot or channel 20, and as will be revealed shortly, the slot or channel 20 is of dual width and dual depth. The upwardly extending portion 22 of the member 14 is preferably disposed at a slight angle to the vertical, usually 10° to 20°, and typically 15°, and the foot member 24 is of sufficient left-right dimension as viewed in this figure, to provide ample stability for the sign or nameplate. As mentioned above, signs utilized with my novel end members can easily have midportions of increased height.

It is to be realized that end members or channel members 12 and 14 are of identical configuration except that they are of opposite hand, such that member 12 can be used on the left edge of the name plates illustrated in FIGS. 12 and 14, whereas member 14 is to be used on the right edge.

In FIGS. 4 and 4*a*, it can be seen more clearly that the channel 20 is of dual depth, and considering these figures in greater detail, dimension "a" represents a portion of the groove or slot 20 that is comparatively wide or thick, and of comparatively shallow depth. This is in contrast to portion "b" of groove or slot 20, which is comparatively narrow and of greater depth. Each of these portions is carefully designed to frictionally receive signs or nameplates of a specific thickness, and to readily retain same.

Obviously I am not to be limited to any particular dimension "a" or dimension "b", but it is a fact that sheet plastic of the type customarily utilized in thecreation of small signs, such as used for nameplates and the like, usually comes in either ⅛ inch thickness, or in 1/16 inch thickness. Because end members or sign supports of the prior art utilized slots or grooves of only a single dimension, it was previously always necessary for an office supply or other such store to stock end members configured to support nameplates of each of several thicknesses of sign material, so that a customer having a nameplate of a certain thickness would need to buy end members precisely conforming to the thickness of plastic that was utilized in the creation of that nameplate.

As should now be apparent, the stocking of nameplate holders or end members of more than one size is now unnecessary, for by purchasing dual function, frictionally fitting end members in accordance with this invention, such end members are immediately usable with nameplates of either of two or more different thicknesses.

Continuing with the embodiment illustrated in FIGS. 4 and 4*a*, dimension "a" may for example represent a channel or slot thickness of ⅛ inch, with the depth of this portion being for example 3/16 inch. Dimension "b" for example may represent a channel or slot thickness of 1/16 inch, with the depth of this portion of the channel or slot being ⅜ inch for example. The total depth of the end member may for example be ½ inch.

As is therefore to be seen, I have presented end members each having a dual depth, dual width slot, with one portion of each such slot having considerable thickness or width and being of comparatively shallow depth, whereas another portion of each such slot is comparatively narrow, and of greater depth.

Obviously I am not to be limited to providing end members furnished with slots or channels of dimensions as set forth hereinabove, for the slots or channels could of course be created so as to tightly receive nameplates or signs of different thicknesses than ⅛ inch and 1/16 inch. Similarly, the thickness of the upstanding member 22 need not be fixed at any particular dimension, but I usuaslly find that a thickness of ⅜ inch is generally satisfactory.

Turning to FIG. 6, it will there be seen that I have shown a cutaway of typical end members 12 and 14 in accordance with my invention, viewed from above. This figure reveals a sign or nameplate 26 of comparatively narrow thickness, and as a result, one end of this nameplate can extend all the way to the bottom of the slot or channel 20, and rest against the innermost portion b of the slot 20 of each member. Because the sign or nameplate 26 is of comparatively narrow thickness, one end of the sign can pass beyond what may be regarded as a step located between the portions a and b, and be frictionally held in place by contact with the interior sidewalls of the two end members of opposite hand.

In other words, FIG. 6 represents the manner in which a sign of comparatively narrow thickness is frictionally held in the lowermost portions of my novel, dual depth nameplate holders, by virtue of its frictional relationship with the deeper portions b of the dual depth slots 20.

Turning to FIG. 7, it will there be seen that I have shown a similar cutaway of the same end members, but this time each end member is receiving one end of a nameplate 28 of a thickness greater than sign or nameplate 26. It will be recalled from FIG. 5 that dimension "a" was wider than "b", with it thus to be understood that sign or nameplate 28 is of a dimension such that it will fill the entire dimension of the portion "a", and thus come into contact with the step that is in effect defined in a midportion of may dual depth slot. In other words, the thicker size of nameplate 28 will prevent its ends from passing down to the deepest portions of the slot 20, as was the case with the nameplate 26.

Consequently, because of the greater thickness of the nameplate 28, its ends will be stopped by the step from entering as far into the slots 20 as did the nameplate 26, but by virtue of its ample frictional contact with the sidewalls of portion "a" of the slot 20, the nameplate will be held in a desirable position.

The indication at Z in FIG. 6 that the thicker nameplate 28 does not extend quite as far into the slot 20 as does the nameplate 26 should be noted in passing, but this is not particularly consequential, for there is still adequate basis for the ends of the thicker nameplate 28 to be frictionally held in a quite satisfactory manner in a desired position in a pair of my novel dual width end members.

I am not to be limited to any particular type or kind of sheet material of which the signs or nameplates are made, nor am I to be limited to any particular type of material in constructing the end members. For example, the end members or channel members can each be made of metal, but preferably, each of the end members or channel members is made of plastic.

I claim:

1. A sign holding arrangement for use on a flat surface, such as a desk or table, comprising a pair of spaced, upstanding parallel channel members opening toward each other to present opposed, facing slots, and also having corresponding feet, said slots each being designed to receive an end of an elongate panel member of a selected thickness, which may present an indicia-bearing face, each said slot in said channel members being of dual width, with one portion of each such slot having comparatively large width or thickness, and comparatively shallow depth, whereas another portion of each such slot having comparatively small width or thickness, and of two differnt thicknesses can be readily received in a tight fitting manner in appropriate portions of said slots.

2. The sign holding arrangement as recited in claim 1 in which the relationship of the upstanding channel members to their respective feet is such that said slots each bear approximately a 15° angle to the vertical.

3. The sign holding arrangement as recited in claim 1 in which each of said channels is made of plastic.

4. The sign holding arrangement as recited in claim 1 in which each of said channels is made of metal.

5. A sign comprising a pair of end members, with each end member having a longitudinal groove, each of said end members having a foot portion configured such that the respective longitudinal groove bears approximately a 15° relationship to the vertical, the longitudinal groove in each of said end members facing the other end member such that a generally rectangular sign of appropriate thickness may be closely received therein, the grooves in said end members being of dual width, with one portion of each such groove being wide and of comparatively shallow depth, whereas another portion of each of said grooves is comparatively narrow, and of greater depth, whereby elongate panel members of either of two different thicknesses can be readily received in a tight fitting manner in appropriate portions of said grooves.

6. The sign as recited in claim 5 in which said end members are each made of plastic.

7. The sign as recited in claim 5 in which each of said channels is made of metal.

8. A sign holding arrangement usable in pairs for supporting the ends of a generally rectangularly shaped nameplate or the like, which nameplate may be of either of two distinctly different thicknesses, and intended to be displayed on the top surface of a desk, table or the like, said sign holding arrangement comprising spaced, upstanding parallel channel members opening toward each other to present opposed, facing slots, and also having corresponding feet, said slots each being designed to receive an end of a rectangularly shaped nameplate of a selected thickness, which nameplate presents an indicia-bearing face, each said slot in said channel members being of dual width, with one portion of each such slot having comparatively large width or thickness, and comparatively shallow depth, whereas another portion of each such slot having comparatively small width or thickness, and of greater depth, whereby rectangularly shaped nameplates of either of two different thicknesses can be readily received in a tight fitting manner in appropriate portions of said slots.

* * * * *